US007267304B2

(12) United States Patent
Scheer

(10) Patent No.: US 7,267,304 B2
(45) Date of Patent: Sep. 11, 2007

(54) RAILROAD YARD SWITCH MACHINE

(76) Inventor: Jerry L. Scheer, 11125 E. County Rd. V Ave., Fremont, NE (US) 68025

( * ) Notice: Subject to any disclaimer, the term of this patent is extended or adjusted under 35 U.S.C. 154(b) by 348 days.

(21) Appl. No.: 11/047,202

(22) Filed: Mar. 21, 2005

(65) Prior Publication Data

US 2006/0208137 A1 Sep. 21, 2006

(51) Int. Cl.
*B61L 5/00* (2006.01)

(52) U.S. Cl. ..... 246/410; 246/411; 246/262; 246/406; 246/407; 246/393

(58) Field of Classification Search ..... 246/262, 246/263, 393, 405, 406, 407, 410, 411, 412, 246/413
See application file for complete search history.

(56) References Cited

U.S. PATENT DOCUMENTS

| | | | | |
|---|---|---|---|---|
| 2,385,799 A | | 10/1945 | Dodge | 192/45.1 |
| 2,744,598 A | | 5/1956 | Troendly | 192/45.1 |
| 3,418,462 A | * | 12/1968 | Wilson et al. | 246/393 |
| 3,449,562 A | * | 6/1969 | Willson | 246/411 |
| 3,621,237 A | * | 11/1971 | Hylen | 246/31 |
| 3,691,371 A | * | 9/1972 | Hylen | 246/393 |
| 3,937,310 A | | 2/1976 | Oldfield | 192/41 A |
| 4,824,054 A | | 4/1989 | Kohake et al. | 246/406 |
| 5,014,937 A | | 5/1991 | Peters | 246/406 |
| 5,531,408 A | | 7/1996 | Wechselberger | 246/257 |
| 6,164,601 A | * | 12/2000 | Scheer et al. | 246/258 |
| 6,732,843 B2 | | 5/2004 | Miura et al. | 192/45.1 |

* cited by examiner

*Primary Examiner*—Mark T. Le
(74) *Attorney, Agent, or Firm*—Thomte Law Office; Dennis L. Thomte

(57) ABSTRACT

A railroad switch machine which is normally operated by an electric motor but which may be manually operated without causing rotation of the power shaft of the electric motor to enable the switch machine to move the switch points without having to overcome the brake resistance applied to the power shaft by the brake and gearbox thereof.

7 Claims, 11 Drawing Sheets

RAILROAD YARD SWITCH MACHINE

BACKGROUND OF THE INVENTION

1. Field of the Invention

The present invention relates generally to railroad yard switch machines, and more particularly to an improved switch machine which may be electrically operated or manually operated, provides run-through capability, and has fewer moving parts than existing switch machines.

2. Description of the Related Art

Machines using hydraulic, pneumatic, or electrical energy to move railroad switch points to remotely or locally change the route of trains have been used for many years. These devices have been very useful for allowing remote operators to control the movement of trains on main lines and side tracks and also for distribution of railroad cars in railroad switch yards.

Within recent years, the use of powered railroad switch movement devices (switch machines) has increased in railroad switch yards as a means of preventing debilitating strains and back injuries to personnel which sometimes results from use of manually-operated switch movement devices (manual switch stands).

One problem with prior art switch machines is the large number of parts, and especially moving parts, thereby requiring frequent maintenance and repair. In addition, typical switch machines utilize gears which can be damaged by vibration of the switch points as railroad cars roll through the switch. Prior art powered switch machines also typically require two motor control relays to permit reversing the direction of a motor to operate the switch machine in opposing directions. These two such relays needlessly increase repair frequency and maintenance costs.

A further problem with conventional switch machines, whether powered or manual, resides in the back injuries sustained during manual operation of such switches. The strain placed on the lower back of a railroad employee while attempting to operate the switch is substantial, and leads to frequent injuries and disabilities.

Applicant solved a large number of the problems in the prior art by way of the invention described in U.S. Pat. No. 6,164,601. In applicant's earlier invention, an improved switch machine was provided where special locking detection features for high-speed main lines were not required. Applicant's earlier invention also provided a switch machine with fewer moving parts and simpler design than existing technology, permitting maintenance-free operation and lower cost. Applicant's earlier invention was also designed to directly replace most of the popular manual switch stands or machines without need for replacing or moving the switch ties, thereby simplifying installation.

Applicant's earlier invention includes a unique mechanism which allows the switch points to be moved in either direction without having to reverse the direction of the motor thereby only requiring one motor control relay instead of two required by the prior art existing electric switch machines. The mechanical mechanism of applicant's earlier patent for moving the switch points was designed to provide a point moving force which follows a general bell curve, to thereby initiate and complete the switching movement at slow speed, with a higher speed movement in the middle of the switching cycle.

Applicant's earlier invention also contains a spring-loaded mechanical release which will prevent damage to the motor and crank mechanism if the points of the switch are prevented from moving by a foreign object or if a train moves through the switch when the points are in the wrong direction and forces the points to the other position (trailed through or run through). Applicant's earlier mechanical release was designed to cause the vertical shaft to hold the points in position as long as the motor is in its stopped position, regardless of correspondence between the crank mechanism position and the position of the points.

Applicant's earlier invention contained a hand-throw lever device which may be used to disengage the crank mechanism from the vertical shaft to permit manual movement of the switch points if electrical power is lost or the motor or crank mechanism fails. Provision was made to allow the switch points to be locked in position using the hand-throw lever if it is desired to prevent remote movement of the switch points by activation of the motor and crank mechanism.

Although the invention of applicant's earlier patent has met with considerable success, some concern has been raised as to the position of the hand-throw lever when it is manually operated since the lever extends outwardly from the machine. Despite the success of applicant's earlier invention, it is believed that the present invention represents a significant improvement over the earlier invention in that a different spring arrangement is utilized in the instant invention and it is believed that the operation of the hand-throw lever device is much easier than applicant's earlier machine. Further, in the instant invention, there is no need to disengage the cam follower assembly from the orthogonally mounted plate on the shaft as in applicant's earlier invention.

SUMMARY OF THE INVENTION

A railway switch machine having a reciprocating throw rod extending therefrom for operating the points of a railway track switch is described which includes a housing having a base plate for supporting the switch machine. The base plate has an opening formed therein which receives a vertically disposed shaft, having upper and lower ends, extending therethrough with the lower end thereof being operably connected to the throw rod. The vertically disposed shaft is rotatable to reciprocate the throw rod to open and close the switch points. A first plate, having an upper surface, is mounted on the vertically disposed shaft for rotation therewith and the upper surface thereof has a plurality of radially spaced grooves and ridges formed therein. A cam follower assembly, having upper and lower ends, is slidably and rotatably mounted on the vertically disposed shaft above the first plate. The cam follower assembly includes a pair of cam followers at its lower end for engagement with oppositely disposed grooves and ridges. A spring means is provided on the vertically disposed shaft above the cam follower assembly to apply a biasing force downwardly on the cam follower assembly. The biasing force yieldably maintains the cam followers within the grooves formed in the upper surface of the first plate. A DC or AC motor is mounted in the housing and has a horizontally disposed and rotatable power shaft extending therefrom with the power shaft only being rotatable in a first direction by the motor. The motor includes a brake which resists the rotation of the power shaft unless the motor is energized.

A horizontally disposed and rotatable hand throw shaft is positioned in the housing in manner which is parallel to and spaced laterally from the power shaft. A drive gear is mounted on the hand throw shaft for rotation therewith and hinge assembly a hand throw handle secured thereto which is positioned outwardly of the housing. The hand throw handle or lever is selectively movable between first and second positions. A driven gear is operably freely rotatably mounted on the power shaft and is in mesh with the drive gear. A crank plate is mounted on the power shaft with a first clutch operably connecting the crank plate to the power shaft. The crank plate is operably connected to the cam follower assembly whereby rotation of the crank plate by the power shaft causes the vertically disposed shaft to reciprocate the throw rod. The first clutch permits the crank plate to rotate on the power shaft in the first direction without rotating the power shaft of the electric motor when rotational force is applied to the crank plate by means other than the power shaft. A second clutch connects the driven gear to the crank plate with the second clutch permitting the crank plate to rotate in the said first direction without causing the rotation of the driven gear in the first direction when the power shaft rotates the crank plate in the first direction. The second clutch causes the crank plate to rotate in the first direction when rotational force is applied to the crank plate by the driven gear rotating in the first direction. The first and second clutches enable the switch points to be moved by means of the hand throw handle and hand throw shaft without rotating the power shaft of the motor if the motor cannot be energized.

These and other objects will be apparent to those skilled in the art.

DETAILED DESCRIPTION OF THE INVENTION

Figure 1:
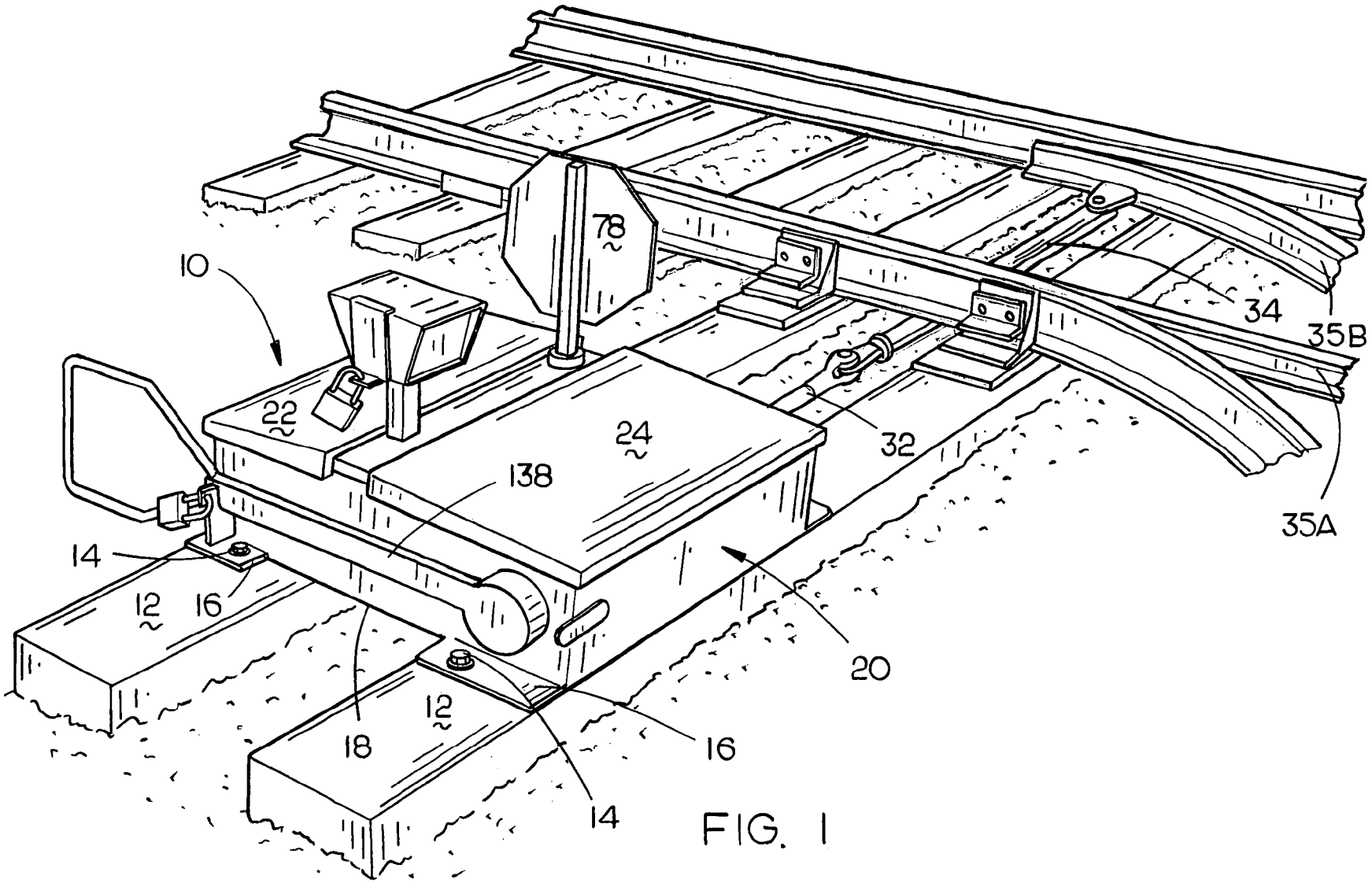
FIG. 1 is a perspective view of the switch machine of this invention and the switch points associated therewith.
Figure 2:
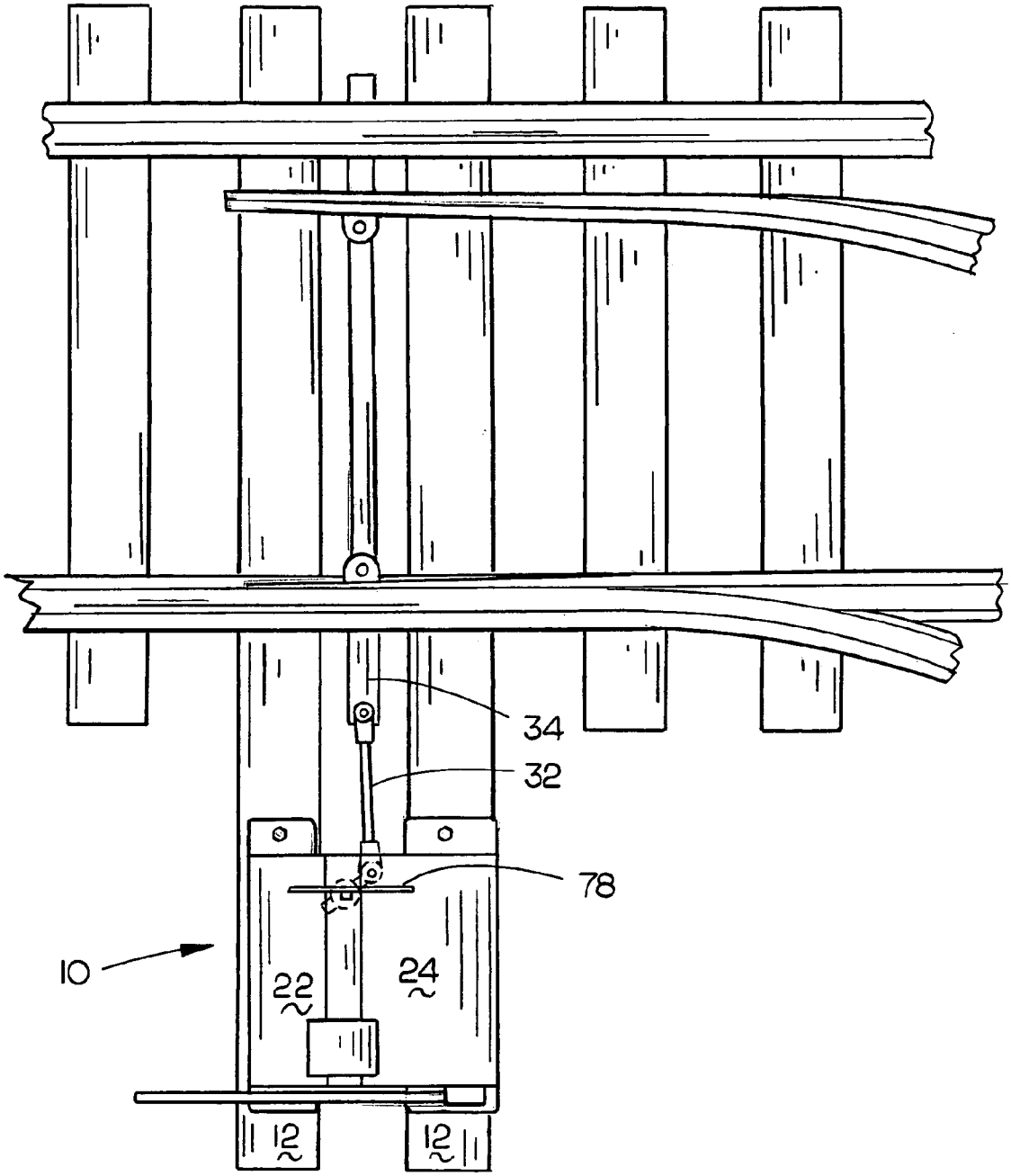
FIG. 2 is a top view of the switch machine and the switch points.

The numeral 10 refers generally to the switch machine of the present invention mounted on switch ties 12 using track spikes, drive screws or bolts 14 driven through holes in the tie mounting plates 16 which are secured to and extend from the base plate or bottom wall 18 of housing 20 which has covers or lids 22 and 24 enclosing the open upper end thereof. Base plate 18 is provided with an opening 26 formed therein through which extends a vertically disposed and rotatable shaft 28.

Figure 6:
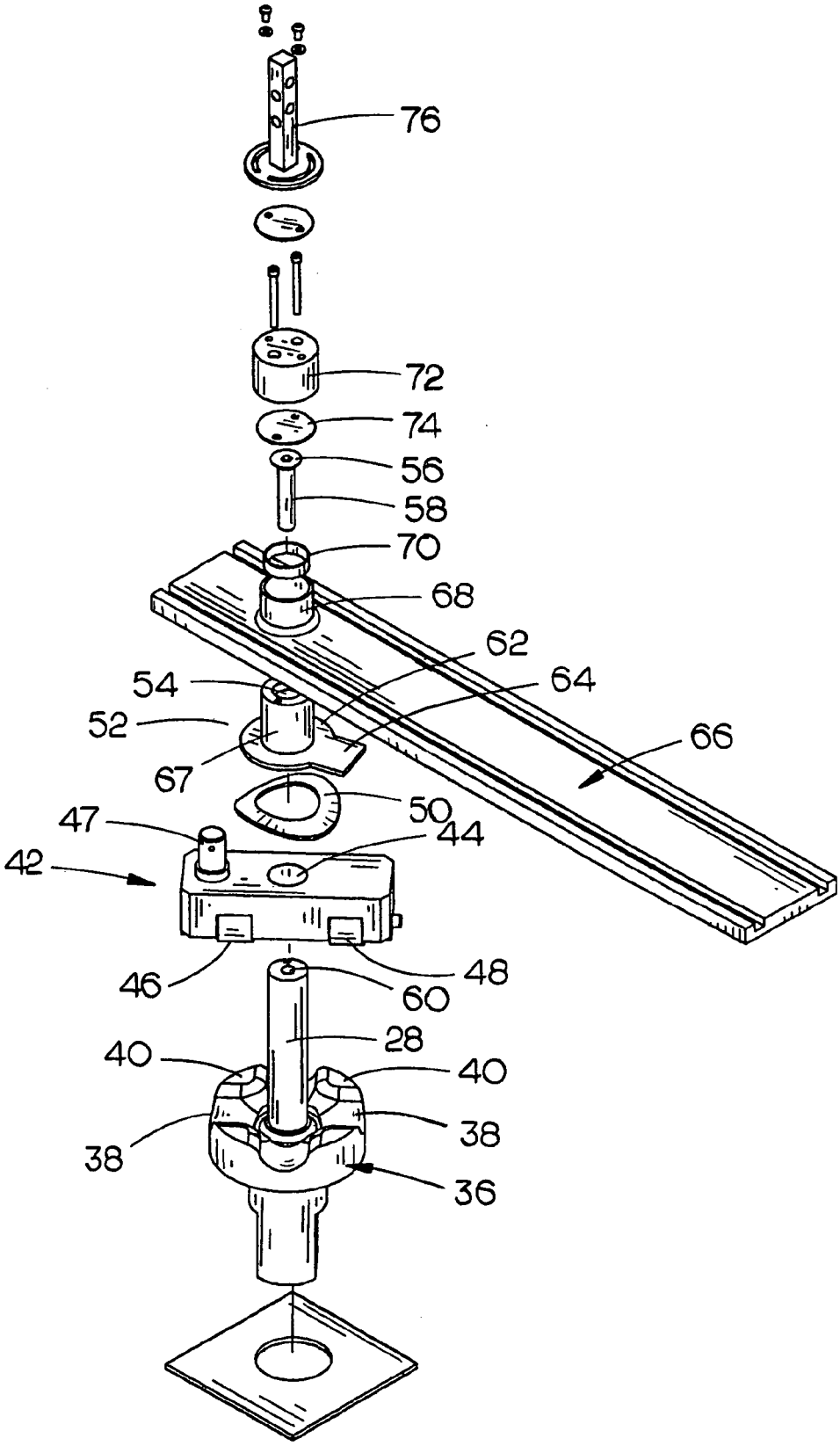
FIG. 6 is an exploded perspective view of a portion of the switch machine.
Figure 11:
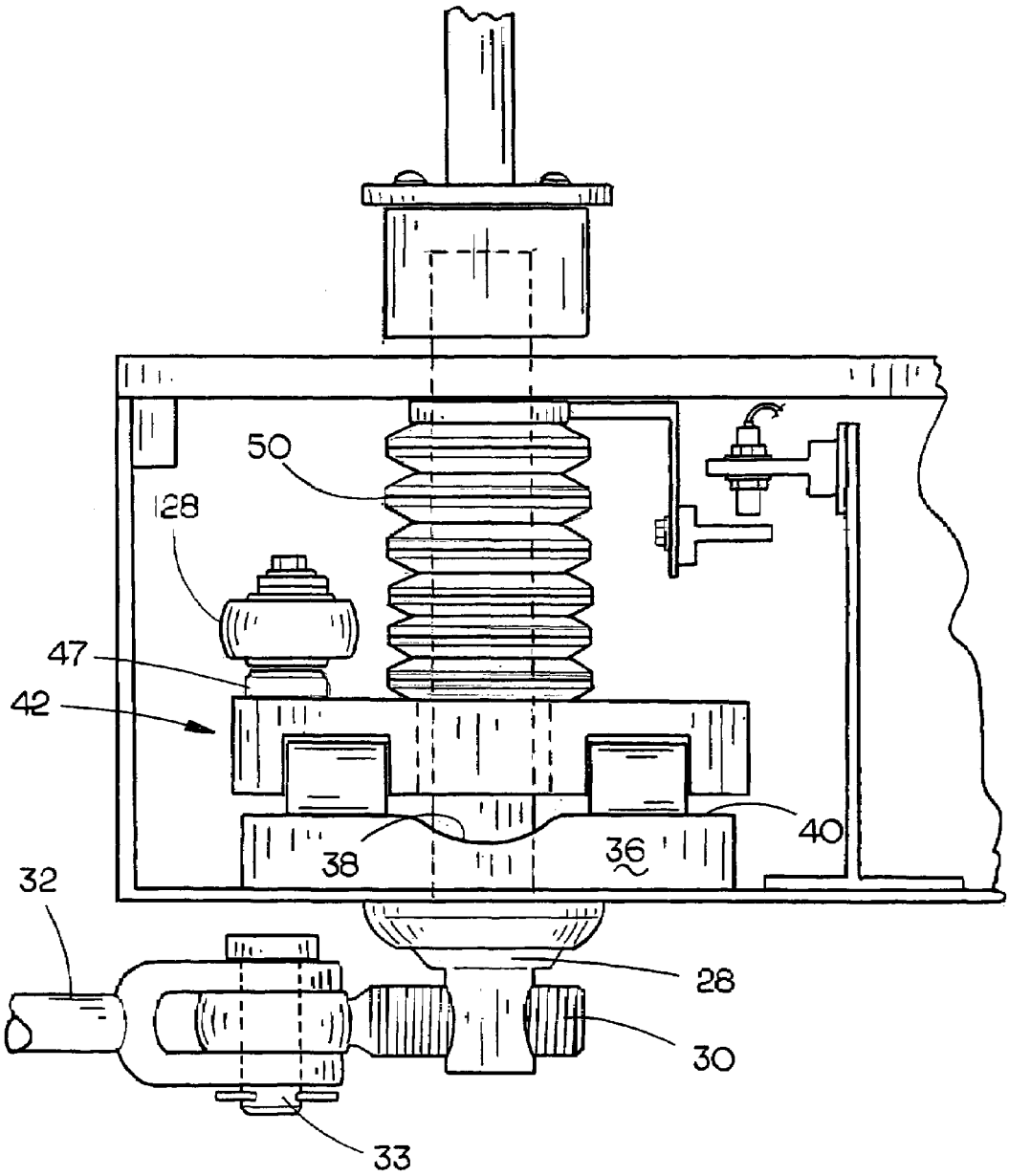
FIG. 11 is a side view illustrating the manner in which the machine is connected to the connecting rod which is pivotally connected to the throw rod extending to the switch points.

The lower end of shaft 28 has an internally threaded bore 29 which extends horizontally therethrough and which threadably adjustably receives the threaded end of a crank eye 30 which has one end of connecting rod 32 secured thereto by means of a pivot bolt 33 (FIG. 11). The other of connecting rod 32 is pivotally connected to the throw rod 34 extending from the switch points 35A and 35B. Shaft 28 is provided with a wave plate 36 having an upper surface which is provided with alternating grooves 38 and ridges 40 therebetween (FIG. 6).

The numeral 42 refers to a cam follower assembly having a central bore 44 which rotatably and slidably receives the upper end of shaft 28. The lower end of cam follower assembly 42 is provided with a pair of spaced-apart rotatable cams or rollers 46 and 48 which are rotatably mounted thereon. One end of the cam follower assembly 42 has an upstanding crank post 47 as will be described in more detail hereinafter. When the cam follower assembly 42 is mounted on the shaft 28, the cams 46 and 48 normally reside in a pair of oppositely disposed grooves 38.

A plurality of Bellville springs 50 are positioned on the upper end of shaft 28 in a plurality of sets of two. The springs 50 in each set of springs are oppositely disposed. In other words, the bottom-most spring in each set of springs will face upwardly while the upper spring in each set will face downwardly.

The numeral 52 refers to a pressure plate having an opening 54 formed therein which receives the upper end of the shaft 28. The lower end of the opening 54 has a reduced diameter which defines a shoulder therein which prevents the head 56 of bolt or screw 58 from extending therethrough. The lower end of bolt or screw 58 is externally threaded and is adapted to be threadably received by the internally threaded bore 60 of shaft 28. Bracket 62 extends laterally from pressure plate 52 and has an arcuate support 64 secured to the outer end thereof. When the screw 58 is tightened into the internally threaded bore 68, the pressure plate 52 applies pressure to the Bellville springs 50 to yieldably maintain the cams 46 and 48 in oppositely disposed grooves 38 in wave plate 36 so that rotation of cam follower assembly 42 will cause rotation of the wave plate 36 and shaft 28.

Figure 7:
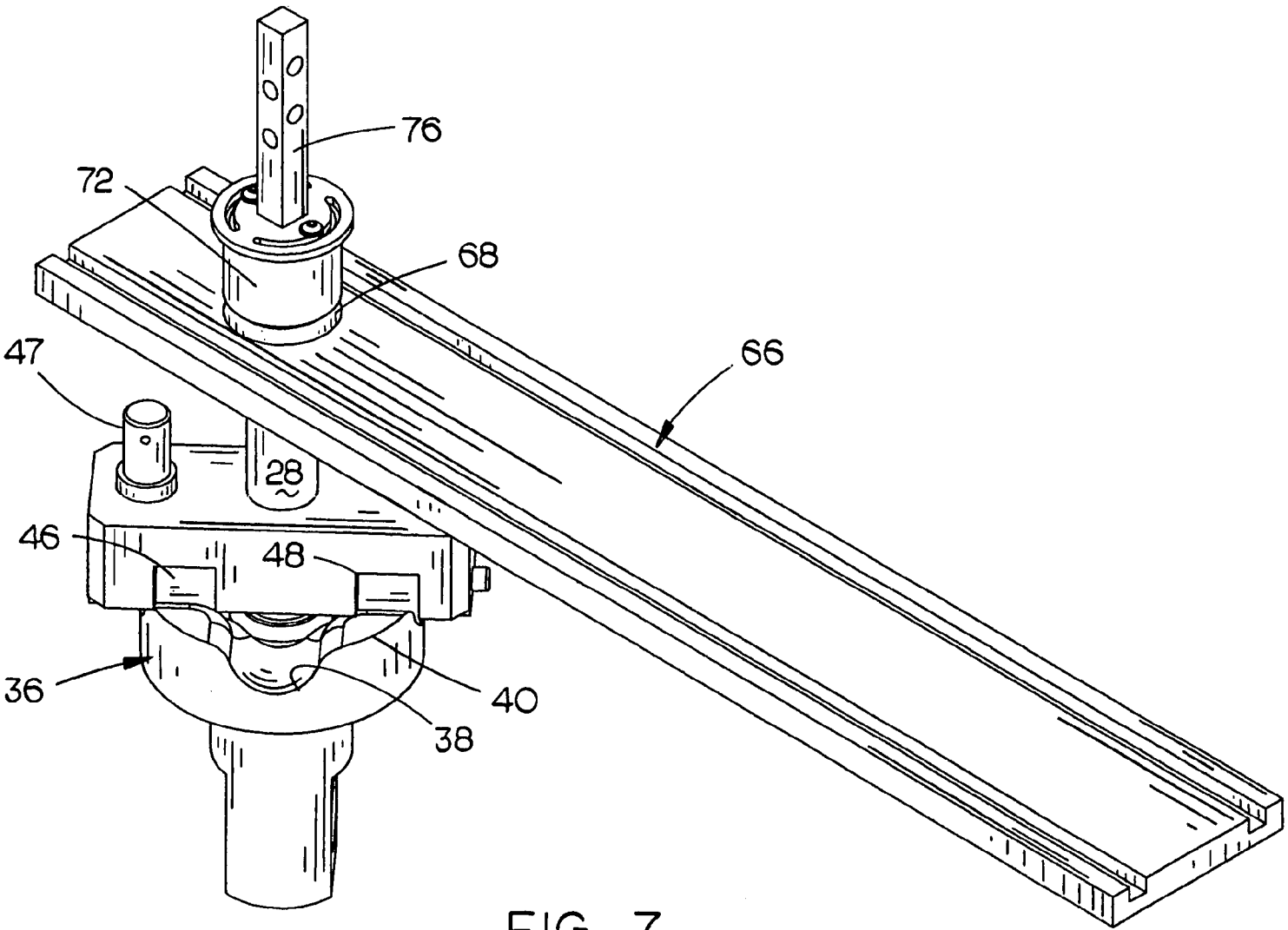
FIG. 7 is a perspective view of the wave plate, cam follower assembly, target post base, etc.
Figure 8:
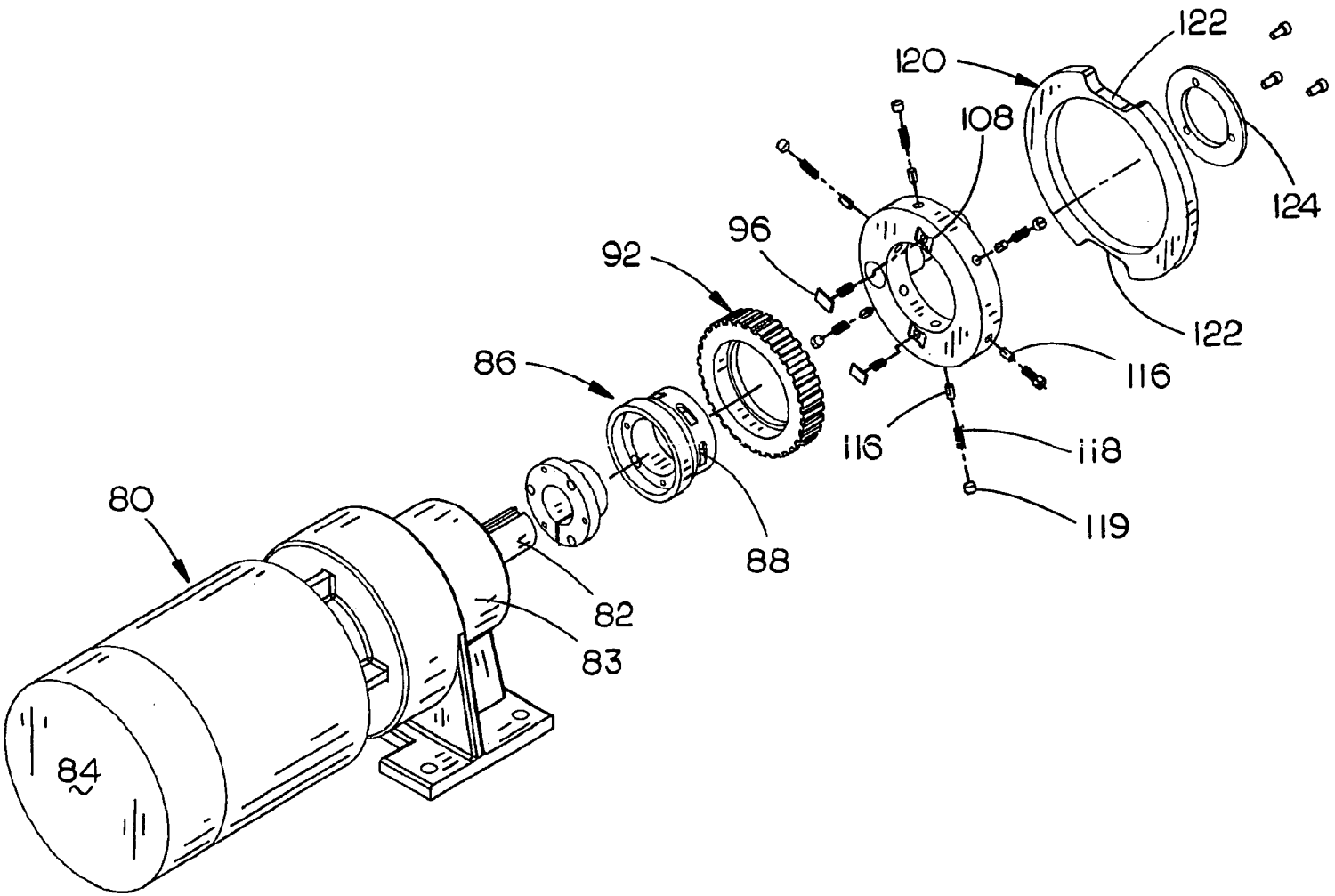
FIG. 8 is an exploded perspective view of the electric motor of the switch stand and some of the associated structure.
Figure 9:
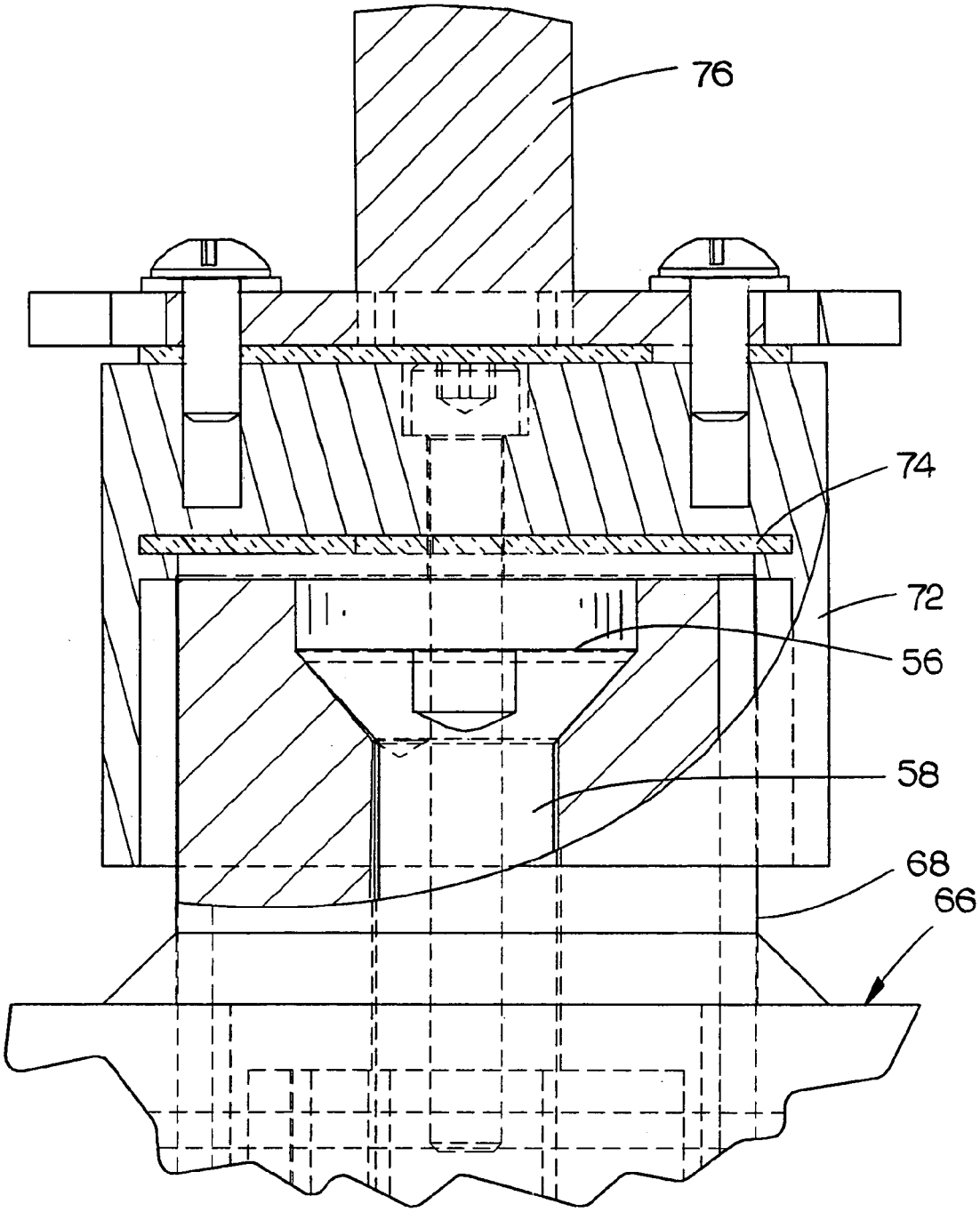
FIG. 9 is a sectional view of the upper portion of the target post base and associated structure.
Figure 10:
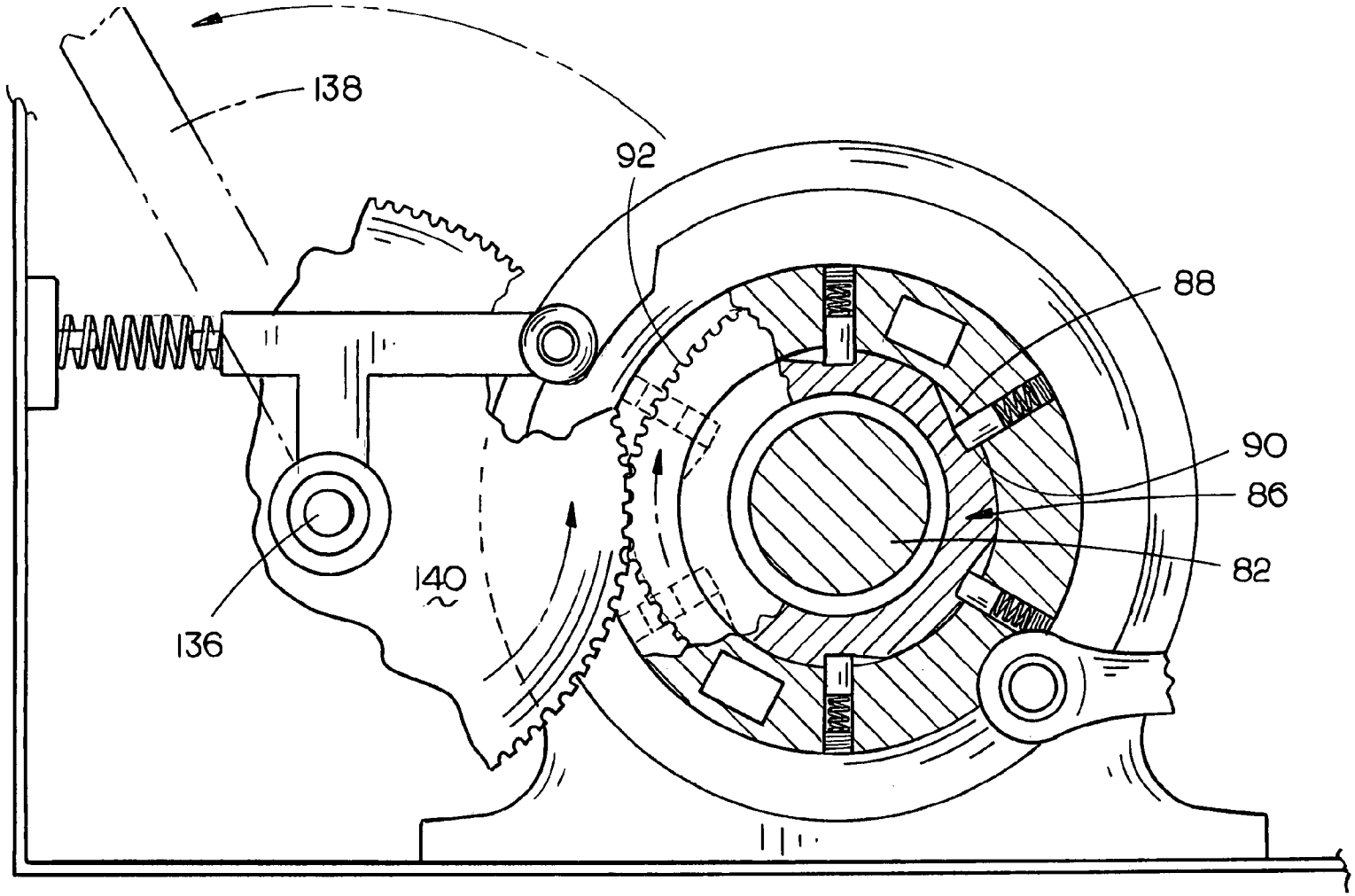
FIG. 10 is a partial sectional view illustrating the relationship of the drive gear, driven gear, clutch plate and lock plate, etc.

Bridge plate 66 is secured to and extends across the open upper end of the housing 20 and has an opening formed therein which registers with the upstanding riser tube 68 (FIG. 7). The upper end 67 of pressure plate 52 is received within the riser tube 68 with a bushing 70 being positioned therebetween. Target post cap 72 is positioned on cap gasket 74 which is positioned on the riser tube 68 with the lower end of post cap 72 rotatably embracing the upper end of the riser tube 68. Target post cap 72 is secured to the upper end of the pressure plate 52 by bolts or screws for rotation therewith. Target post base 76 is secured to the upper end of the target post cap 72 by screws or bolts. Target 78 is secured to the target post base 76 and extends upwardly therefrom in conventional fashion to advise the workers whether the switch is open or closed.

Figure 5:
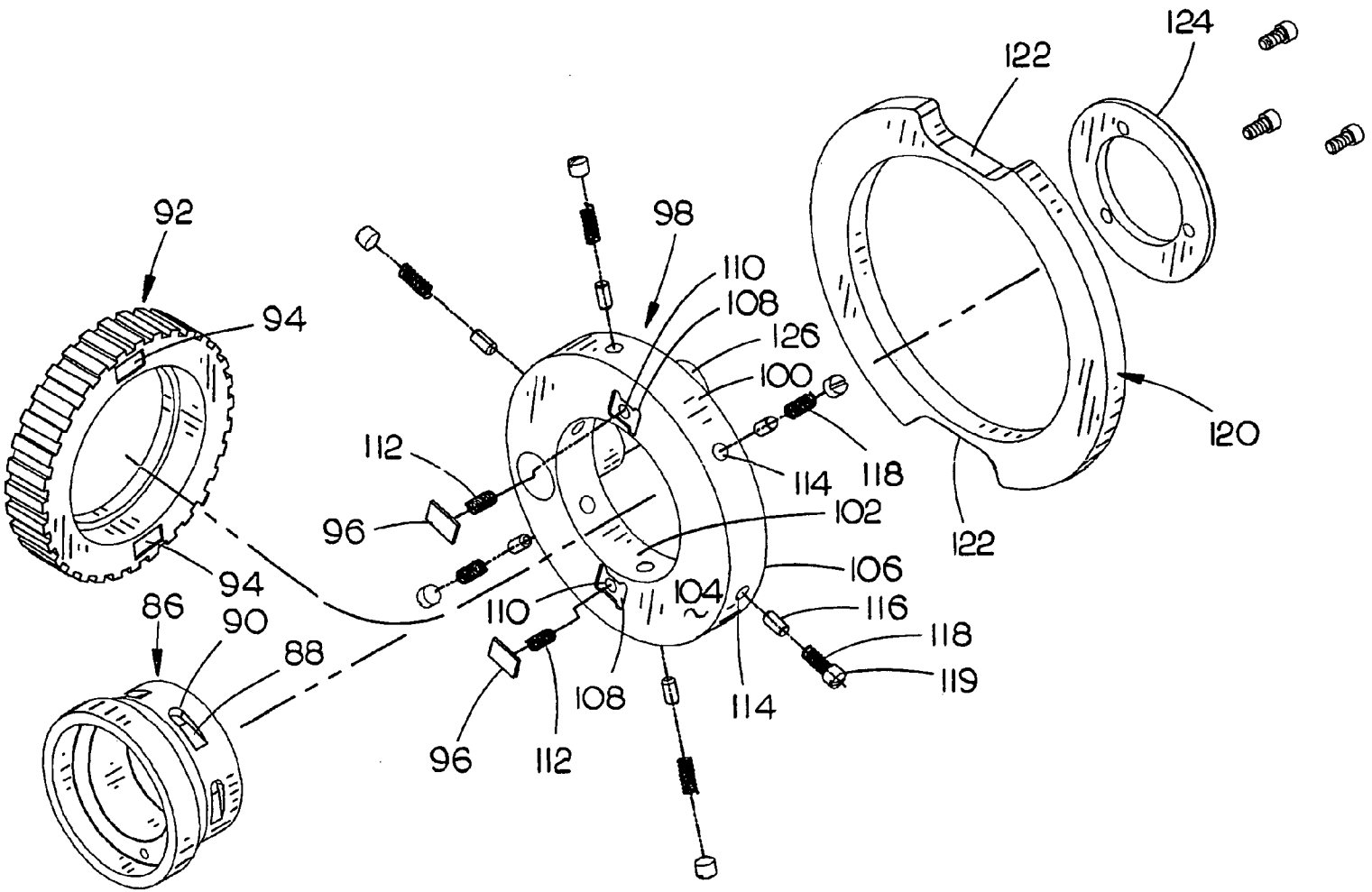
FIG. 5 is an exploded perspective view of a portion of the switch machine.

The numeral 80 refers to an AC or DC electric motor secured to the base plate 18 and includes a power shaft 82 extending therefrom. Motor 80 includes a brake 84 which prevents rotation of the shaft 82 unless the motor 80 is energized. Motor 80 is a non-reversible motor and rotates in a counterclockwise direction as viewed from the brake end of the motor. Motor 80 also includes a conventional gearbox assembly 83. A tapered bearing 86 is mounted on power shaft 82 for rotation therewith. The outer periphery of tapered bearing 86 includes a plurality of radially spaced cam surfaces 88 which extend into the tapered bearing 86 and which terminate in shoulders 90. Driven gear 92 is freely rotatably mounted on the inner end of the tapered bearing 86. The outer face of driven gear 92 is provided with a pair of oppositely disposed sprag pockets 94 formed therein, each of which are adapted to receive a conventional sprag 96 therein (FIG. 5).

The numeral 98 refers to a crank plate having an outer peripheral surface 100, an inner ring-shaped surface 102, inner face 104 and outer face 106. Inner face 104 is also provided with a pair of oppositely disposed sprag pockets 108 milled therein which are adapted to receive the spring-loaded sprags 96 therein. A pair of openings 110 extend inwardly from outer face 106 of crank plate 98 and communicate with the sprag pockets 108 (FIG. 5). A spring 112 is positioned in each of the openings 110 to urge the sprags 96 towards the sprag pockets 94 in gear 92. The sprag pockets 94 and 108 and the sprags 96 are designed to act as a sprag clutch between the driven gear 92 and the crank plate 98 as will be explained in more detail hereinafter.

Crank plate 98 has a plurality of bores 114 extending between surfaces 100 and 102, each of which receives tubular dowels or sprags 116 therein. The number of bores 114 will correspond to the number of cam surfaces 88 formed in tapered bearing 86. Springs 118 are positioned in the bores 114 outwardly of the sprags 116 and are maintained therein by Allen screws 119 or the like so that the springs 118 urge the dowels or sprags 116 into yieldable engagement with the cam surfaces 88. The springs 118, in cooperation with the cam surfaces 88, act as a clutch between the tapered bearing 86 and the crank plate 98, as will be described in more detail hereinafter. Notch or lock ring 120 embraces crank plate 98 and is secured thereto by means of set screws extending inwardly through the notch ring 120 and being threadably received by threaded bores in the outer peripheral surface 100 of crank plate 98. Notch ring 120 has a pair of spaced-apart notches 122 formed in the peripheries thereof. Retainer 124 is positioned adjacent the outer face of crank plate 98 and is secured to tapered bearing 86 by screws or the like and is secured to power shaft 82 by a key or the like. As seen in the drawings, crank plate 98 has a crank shaft 126 extending outwardly therefrom. One end of an adjustable rod eye 128 is rotatably, pivotally and swivelly connected to crank shaft 126. The outer end of crank shaft 126 is rotatably secured to one end of a pivot arm 130 which is rotatably mounted on a shaft 136 extending inwardly from a bearing 132 secured to the end wall of housing 20. Adjustable rod eye 128 is rotatably secured, at its other end, to the post 47 which extends upwardly from one end of cam follower assembly 42.

Hand throw shaft 136 rotatably extends into the housing 20 and has its opposite ends received by and rotatably supported in suitable bearings secured to the housing. Hand throw lever 138 extends transversely from the outer end of shaft 136 and is selectively movable from a horizontally disposed position closely adjacent the housing 20 to a position extending upwardly therefrom. A drive gear 140 is mounted on shaft 136 within housing 20 for rotation with the shaft 136 and is in engagement or mesh with gear 92. The lower end of pivot plate 142 is pivotally mounted on shaft 136 and has a roller 143 mounted at its upper inner end which rolls upon the outer periphery of the notch ring 120. Spring 144 yieldably urges the pivot plate 142 towards the notch ring 120 to ensure the engagement of the roller 143 with the notch ring 120. Bracket 146 extends upwardly from the pivot plate 142 and moves therewith so as to move into and out of one end of a proximity switch 148 secured to the inner surface of housing 20.

The numeral 154 refers to a proximity mount having a semi-circular bracket 156 at the upper end thereof which has proximity switches 158 and 160 adjustably mounted thereon. A proximity actuator assembly 162 is mounted on the upper end of shaft 28 for rotation therewith and has a pair of spaced-apart actuators 164 and 166 mounted thereon which are adapted to actuate switches 158 and 160, respectively. The actuators 164, 166 and switches 158, 160 are selectively adjusted so that switch 158 will be actuated when the switch points have reached their closed position and so that switch 160 will be actuated when the switch points have reached their open position.

Assuming that the switch points are in their open position, the machine 10 operates (electrically) as follows to close the switch points. The start button for the motor 80 is depressed momentarily to energize or activate the motor 80 so that power shaft 82 rotates in a counterclockwise direction as viewed from the rear of motor 80. As power shaft 82 rotates in a counterclockwise direction, tapered bearing 86 also rotates in a counterclockwise direction with power shaft 82 which causes crank plate 98 and lock ring 120 to also rotate in a counterclockwise direction. Tapered bearing 86 drives crank plate 98 in a counterclockwise direction due to the engagement of the spring-loaded sprags or dowels 116 mounted in crank plate 98 with the shoulders 90 at the ends of the cam surfaces 88 formed in tapered bearing 86. At this time, gear 92 does not rotate due to the non-engagement of the sprags 96 positioned in the sprag pockets 108 in crank plate 98 with the sprag pockets 94 on gear 92. As will be explained hereinafter, rotation of driven gear 92 in a counterclockwise direction by gear 140 will cause crank plate 98 to be rotated in a counterclockwise direction. As also described hereinafter, counterclockwise rotation of crank plate 98 by the driven gear 92 does not cause rotation of power shaft 82 since the spring-loaded sprags 116 will move out of the cam surfaces 88 at the opposite ends thereof from the shoulders 90.

At the beginning of the cycle described above, roller 143 will be in one of the notches 122 in lock ring 120. When the roller 143 is in one of the notches 122, the pivot plate 142 will be in its inward pivoted position so that the bracket 146 thereon will be adjacent proximity switch 148 which is the motor stop by deenergizing contactor to the motor. As crank plate 98 and lock ring 120 are initially rotated in a counterclockwise direction by power shaft 82, the roller 143 moves up the tapered cam end 150 of the notch 122 and rolls upon the peripheral surface of lock ring 120 until it moves into the other notch 122. When positioned in the notch 122, the lock ring 120 cannot be rotated in a clockwise direction due to the engagement of the roller 143 with the lock end 152 of the notch 122 due to the shoulder-like design of the lock end 152. The engagement of the roller 143 with the lock end 152 keeps pressure on the switch points to maintain the switch points in position.

Rotation of crank plate 98 causes rod eye 128 to be reciprocatably moved towards cam follower assembly 42 thereby causing the rotational movement thereof which causes wave plate 36 to rotate therewith due to the positioning of the cams 46 and 48 in a pair of oppositely disposed grooves 38. The spring force of the Bellville springs 50 yieldably maintains the cams 46 and 48 in the grooves 38 to act as a spring-loaded slip clutch which drives or rotates wave plate 36 and shaft 28. If sufficient resistance is encountered during the opening or closing of the switch points due to an obstruction or the like which prevents complete opening or closing of the switch points, the cams 46 and 48 will move upwardly out of the grooves 38 against the resistance of the springs 50 so that throw rod 34 will not be further moved with respect to the obstruction.

Assuming that an obstruction is not encountered in the cycle described above, the throw rod 34 and connecting rod 32 will be moved by the rotating crank eye 30 at the lower end of the shaft 28. Rotation of the shaft 28 causes rotation of the target post base 76 and target 78 so that target 78 will indicate the position of the switch. The crank plate 98 continues its counterclockwise rotation described above until actuator 166 moves adjacent to switch 160 to actuate the same which causes motor 80 to be deactivated. In the event that an obstruction prevents the switch points from completely moving to their closed position, the crank plate 98 will continue to rotate, with the cam follower assembly rotating with respect to the non-moving wave plate 36, until the roller 143 moves into a notch 122 thereby actuating proximity switch 148 which will deactivate motor 80. Since shaft 28 and wave plate 36 did not completely rotate to the normal "closed" position, the target 78 will indicate the malfunction. The obstruction may then be removed and the machine re-set. The switch point opening cycle is performed in the manner set forth above except for the direction of movement of the throw rod 34, connecting rod 32, and rod eye 128. In a trail through situation, the lock ring 120 prevents movement of the switch points. Movement of the switch points in a trail through situation is also prevented by the sprag clutch positioned between the crank plate 98 and the tapered bearing 86.

In the event of a power outage, the machine may be manually operated to open or close the switch points as follows. The hand throw lever 138 is unlocked and pivotally moved upwardly from its horizontally disposed position to its raised position. The upward movement of lever 138 causes hand throw shaft 136 to be rotated in a clockwise direction as viewed from the rear of the machine. Clockwise movement of shaft 136 causes drive gear 140 to also be rotated in a clockwise direction which in turn causes driven gear 92 to be rotated in a counterclockwise direction. Counterclockwise rotation of gear 92 causes clutch plate 98 to be rotated in a counterclockwise direction due to the spray slip clutch connection of gear 92 and clutch plate 98 as described above. Counterclockwise rotation of gear 92 does not cause rotation of tapered bearing 86 or power shaft 82 due to the spray slip clutch connection of crank plate 98 with respect to tapered bearing 86 as described hereinabove. Continued rotational movement of shaft 136 by lever 138 causes the machine to function as if crank plate 98 was being driven by motor 80. One upward cycle of lever 138 causes the switch points to be moved from their open position to their closed position. The lever 138 is then returned to its horizontal position. If it is then desired to open the switch points, a second cycle of the lever 138 will accomplish the same.

Figure 3:
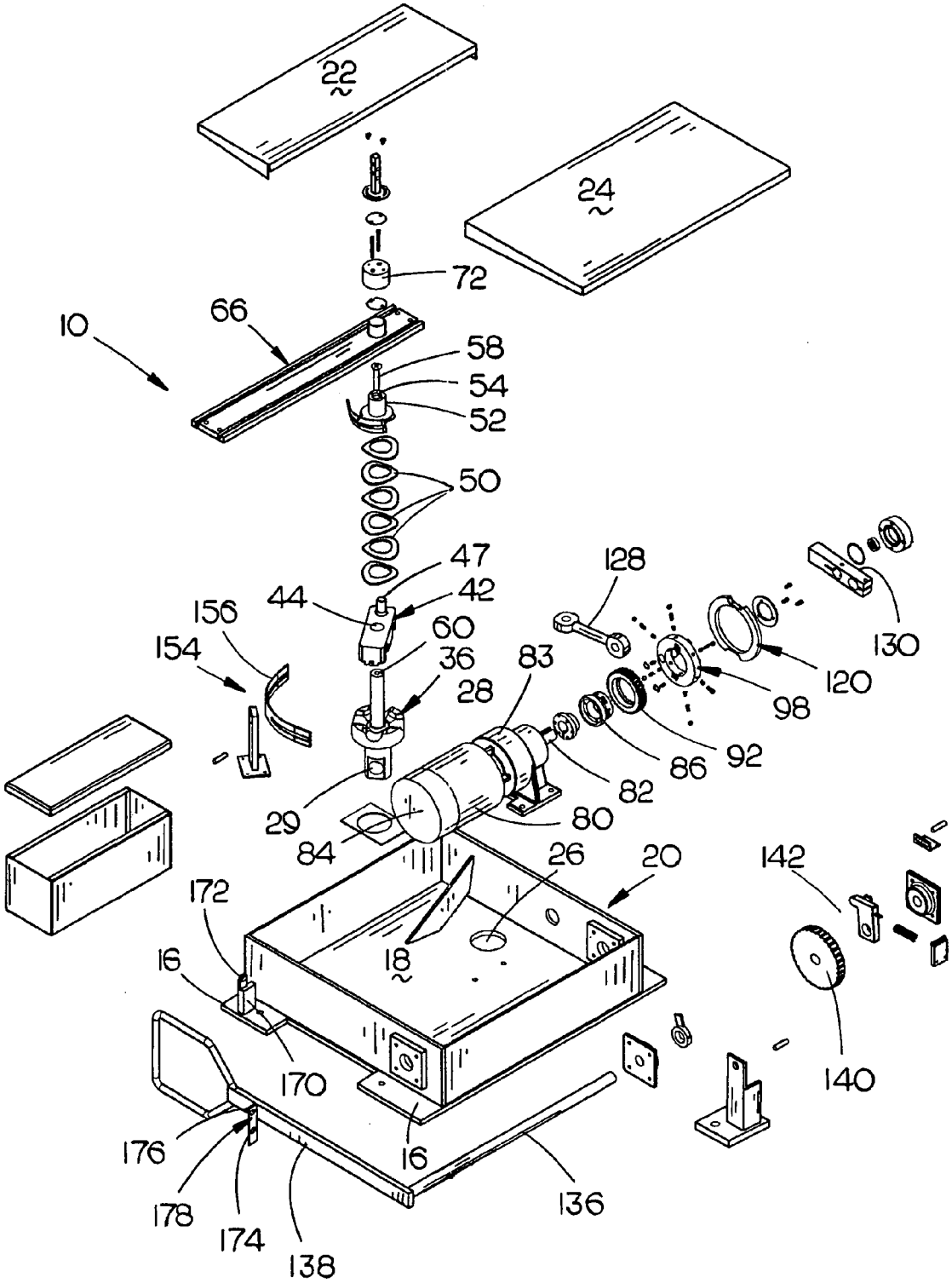
FIG. 3 is an exploded perspective view of a portion of the switch machine.
Figure 4:
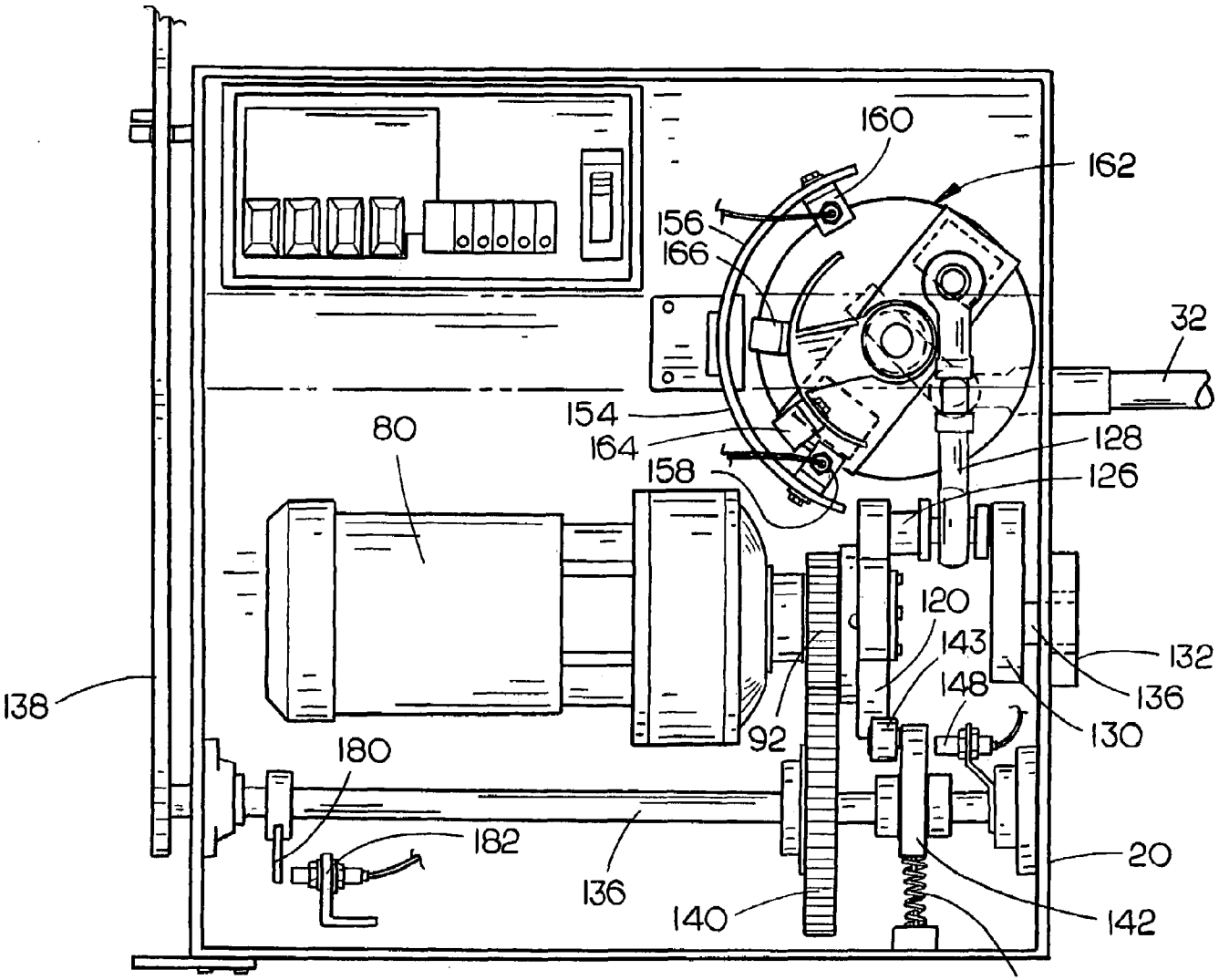
FIG. 4 is a top elevational view of the switch machine with the cover thereof removed.

A bracket or post 170 extends upwardly from one of the plates 16 and has an opening 176 formed therein which is adapted to register with one of the openings 174 or 176 formed in bracket 178 which is secured to lever 138 (FIG. 3). When opening 172 registers with opening 176, the actuator 180 on shaft 136 will be adjacent proximity switch 182 positioned within housing 20 so that motor 80 is able to be actuated. Lever 138 may be locked in this position with a padlock or the like. When opening 174 registers with opening 172, actuator 180 will not be adjacent proximity switch 182 which will prevent motor 80 from being actuated. Lever 138 may be locked in this "blue" position by a padlock or the like to prevent accidental actuation of motor 80.

Thus it can be seen that the invention accomplishes at least all of its stated objectives.

I claim:

1. A railway switch machine having a reciprocating throw rod extending therefrom for operating the points of a railway track switch, comprising:

a housing including a base plate for supporting the switch machine;

said base plate having an opening formed therein;

a vertically disposed shaft, having upper and lower ends, extending through said opening in said base plate with said lower end thereof being operably connected to the throw rod;

said vertically disposed shaft being rotatable to reciprocate the throw rod;

a first plate, having an upper surface, mounted on said vertically disposed shaft for rotation therewith;

said upper surface of said first plate having a plurality of radially spaced grooves and ridges formed therein;

a cam follower assembly, having upper and lower ends, slidably and rotatably mounted on said vertically disposed shaft above said first plate;

said cam follower assembly including at least one cam follower at its said lower end for engagement with said grooves and ridges;

biasing means on said vertically disposed shaft above said cam follower assembly;

said biasing means applying a biasing force downwardly on said cam follower assembly;

said biasing force yieldably maintaining said cam follower within one of said grooves formed in said upper surface of said first plate;

a motor in said housing having a horizontally disposed and rotatable power shaft extending therefrom;

said power shaft being rotatable only in a first direction by said motor;

said motor including a brake which resists the rotation of said power shaft unless said motor is energized;

a horizontally disposed and rotatable hand throw shaft positioned in said housing which is parallel to and spaced laterally from said power shaft;

a drive gear mounted on said hand throw shaft for rotation therewith;

a hand throw handle positioned outwardly of said housing which is connected to said hand throw shaft;

said hand throw handle being selectively movable between first and second positions;

a driven gear operably freely rotatably mounted on said power shaft;

said driven gear being in mesh with said drive gear;

a crank plate mounted on said power shaft;

a first clutch operably connecting said crank plate to said power shaft;

said crank plate being operably connected to said cam follower assembly whereby rotation of said crank plate by said power shaft causes said vertically disposed shaft to reciprocate the throw rod;

said first clutch permitting said crank plate to rotate on said power shaft in said first direction without rotating said power shaft when rotational force is applied to said crank plate by means other than said power shaft;

a second clutch connecting said driven gear to said crank plate;

said second clutch permitting said crank plate to rotate in said first direction without causing the rotation of said driven gear in said first direction when said power shaft rotates said crank plate in said first direction;

said second clutch causing said crank plate to rotate in said first direction when rotational force is applied to said crank plate by said driven gear rotating in said first direction;

said first and second clutches enabling the switch points to be moved by means of said hand throw handle and said hand throw shaft without rotating said power shaft of said motor if said motor cannot be energized.

2. A railway switch machine having a reciprocating throw rod extending therefrom for operating the points of a railway track switch, comprising:

a housing including a base plate for supporting the switch machine;

said base plate having an opening formed therein;

a vertically disposed shaft, having upper and lower ends, extending through said opening in said base plate with said lower end thereof being operably connected to the throw rod;

said vertically disposed shaft being rotatable to reciprocate the throw rod;

a first plate, having an upper surface, mounted on said vertically disposed shaft for rotation therewith;

said upper surface of said first plate having a plurality of radially spaced grooves and ridges formed therein;

a cam follower assembly, having upper and lower ends, slidably and rotatably mounted on said vertically disposed shaft above said first plate;

said cam follower assembly including at least one cam follower at its said lower end for engagement with said grooves and ridges;

biasing means on said vertically disposed shaft above said cam follower assembly;

said biasing means applying a biasing force downwardly on said cam follower assembly;

said biasing force yieldably maintaining said cam follower within one of said grooves formed in said upper surface of said first plate;

a drive motor including a power shaft which rotates in a first direction;

a bearing mounted on said power shaft for rotation therewith in said first direction;

a first ring gear freely rotatably mounted on said bearing;

a crank plate mounted on said bearing;

a first clutch connecting said crank plate to said bearing;

said first clutch causing said crank plate to rotate with said bearing when said bearing is rotated in said first direction by said power shaft;

said first clutch permitting said crank plate to rotate on said bearing in said first direction without rotating said first bearing when rotational force is applied to said crank plate other than said bearing;

a second clutch connecting said crank plate and said first ring gear which permits said crank plate to rotate in said first direction without causing the rotation of said ring gear when said bearing rotates said crank plate in said first direction;

said second clutch causing said crank plate to rotate in said first direction when rotational force is applied to said crank plate by said first ring gear rotating in said first direction;

said crank plate being operatively connected to said throw rod;

a hand throw lever;

a hand throw shaft operatively connected to said hand throw lever;

a second ring gear mounted on said hand throw shaft which is in meshing engagement with said first ring gear;

said hand throw lever being selectively movable from a rest position towards a throw position;

said movement of said hand throw lever towards said throw position causing said second ring gear to rotate said first ring gear in said first position without rotating said power shaft whereby said crank plate will rotate in said first direction thereby causing said vertically disposed shaft to reciprocate the throw rod.

3. A railway switch machine having a reciprocating throw rod extending therefrom for operating the points of a railway track switch, comprising:

a support for supporting the switch machine;

a vertically disposed shaft, having upper and lower ends, operatively rotatably mounted on said support;

said vertically disposed shaft being rotatable to reciprocate the throw rod;

a first plate, having an upper surface, mounted on said vertically disposed shaft for rotation therewith;

said upper surface of said first plate having a plurality of radially spaced grooves and ridges formed therein;

a cam follower assembly, having upper and lower ends, slidably and rotatably mounted on said vertically disposed shaft above said first plate;

said cam follower assembly including at least one cam follower at its said lower end for engagement with said grooves and ridges;

biasing means on said vertically disposed shaft above said cam follower assembly;

said biasing means applying a biasing force downwardly on said cam follower assembly;

said biasing force yieldably maintaining said at least one cam follower within at least one of said grooves formed in said upper surface of said first plate;

a motor in said housing having a horizontally disposed and rotatable power shaft extending therefrom;

said power shaft being rotatable only in a first direction by said motor;

a horizontally disposed and rotatable hand throw shaft positioned in said housing which is parallel to and spaced laterally from said power shaft;

a drive gear mounted on said hand throw shaft for rotation therewith;

a hand throw handle movably positioned on said support which is connected to said hand throw shaft;

said hand throw handle being selectively movable between first and second positions;

a driven gear operably freely rotatably mounted on said power shaft;

said driven gear being in mesh with said drive gear;

a crank plate mounted on said power shaft;

a first clutch operably connecting said crank plate to said power shaft;

said crank plate being operably connected to said cam follower assembly whereby rotation of said crank plate by said power shaft causes said vertically disposed shaft to reciprocate the throw rod;

said first clutch permitting said crank plate to rotate on said power shaft in said first direction without rotating said power shaft when rotational force is applied to said crank plate by means other than said power shaft;

a second clutch connecting said driven gear to said crank plate;

said second clutch permitting said crank plate to rotate in said first direction without causing the rotation of said driven gear in said first direction when said power shaft rotates said crank plate in said first direction;

said second clutch causing said crank plate to rotate in said first direction when rotational force is applied to said crank plate by said driven gear rotating in said first direction;

said first and second clutches enabling the switch points to be moved by means of said hand throw handle and said hand throw shaft without rotating said power shaft of said motor if said motor cannot be energized.

4. The switch machine of claim 1 wherein a lock ring is operatively secured to said crank plate for rotation therewith; said lock ring having at least a pair of spaced-apart notches formed in the periphery thereof; and wherein a spring-loaded roller assembly is movably mounted on said housing which has a roller which rolls along the periphery and notches of said lock ring; and wherein a proximity switch is positioned adjacent said roller assembly for controlling the operation of said motor.

5. The switch machine of claim 4 wherein said lock ring also functions to prevent rotation of said crank plate in a direction opposite to said first direction.

6. The switch machine of claim 1 wherein a pair of horizontally spaced-apart proximity switches are positioned laterally of said vertically disposed shaft, said shaft having a switch actuator mounted thereon for actuating said proximity switch;

said proximity switches being operatively connected to said motor for controlling the operation thereof.

7. The switch machine of claim 2 wherein a proximity switch is mounted on said support adjacent said hand throw shaft, said hand throw shaft having a switch actuator mounted thereon which is adapted to actuate said proximity switch when said throw rod shaft is rotated a predetermined amount, said proximity switch being operably connected to said motor to disengage said motor when said switch actuator is positioned adjacent said proximity switch.

* * * * *